US006419771B1

(12) United States Patent
Lormand

(10) Patent No.: US 6,419,771 B1
(45) Date of Patent: Jul. 16, 2002

(54) NON-TOXIC HYPERGOLIC MISCIBLE FUEL WITH STABLE STORAGE CHARACTERISTICS

(75) Inventor: Bradley M. Lormand, Davis, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/510,993

(22) Filed: Feb. 22, 2000

(51) Int. Cl.[7] ..... C06B 47/00; C06B 31/00; C06D 5/00

(52) U.S. Cl. ..... 149/1; 149/45; 149/108.6; 60/211; 60/212

(58) Field of Search ..... 149/1, 45, 108.6; 60/211, 212, 215

(56) References Cited

U.S. PATENT DOCUMENTS 2,835,106 A * 5/1958 Carter ..... 60/35.4
2,874,535 A * 2/1959 Ayers et al. ..... 60/35.4
2,896,407 A * 7/1959 Zletz et al. ..... 60/35.4
3,082,598 A * 3/1963 Mahan ..... 60/35.4
3,142,151 A * 7/1964 Roberts et al. ..... 60/35.4
3,700,393 A * 10/1972 Mueller ..... 60/214
3,740,947 A * 6/1973 Denson et al. ..... 60/215
4,316,359 A * 2/1982 Sayles ..... 60/212
4,698,965 A * 10/1987 Delchev et al. ..... 60/227
5,932,837 A 8/1999 Rusek et al.

* cited by examiner

*Primary Examiner*—Michael J. Carone
*Assistant Examiner*—Aileen J. Baker
(74) *Attorney, Agent, or Firm*—Anthony J. Serventi

(57) ABSTRACT

The non toxic bipropellent of the present invention contains a non-toxic hypergolic miscible fuel (hereinafter referred to as "NHMF") and a rocket grade hydrogen peroxide. This NHMF has rapid ignition capability and minimizes the formation of precipitate, even when exposed to extreme heat or water. The NHMF of this invention contains 5 species. Namely, a polar organic species miscible with hydrogen peroxide; a propagator, which may be substituted or unsubstituted amines, amides or diamines; an inorganic metal salt, which reacts to form a catalyst in solution or as a colloid; acetic acid; and alkali acetate. The inorganic metal salt is miscible with the polar organic species and the propagator in solution. The catalyst has a faster rate of reaction with said rocket grade hydrogen peroxide than the propagator, the propagator has a faster rate of reaction with the rocket grade hydrogen peroxide than the polar organic species, and the polar organic species, propagator and catalyst are mutually soluble. The pH is buffered with the addition of acetic acid and alkali acetate. Acetic acid is a relatively innocuous acid that can be added easily without adding any water to the fuel and the alkali acetate yields free acetate ions, which complete the buffer with acetic acid.

16 Claims, No Drawings

NON-TOXIC HYPERGOLIC MISCIBLE FUEL WITH STABLE STORAGE CHARACTERISTICS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

MICROFICHE APPENDIX

Not Applicable.

BACKGROUND OF THE INVENTION

1. Field of the Invention

The present invention relates in general to a non-toxic hypergolic bipropellent and, more particularly, to a non-toxic bipropellent which contains a non-toxic hypergolic miscible fuel (hereinafter referred to as "NHMF")and a rocket grade hydrogen peroxide oxidizer. The NHMF of this invention contains a polar organic species, a propagator, an inorganic metal salt, an alkali acetate and acetic acid.

2. Description of Related Art

Innovative propellants have long been used by the United States Navy for power generation, propulsion and ordnance. Prime considerations in the post World War II era have been specific impulse, volumetric energy content, surge/mobilization readiness and shipboard safety. While these parameters are still important, environmental concerns, commercial transitions and cost have been added to the list of considerations to be taken into account.

Traditional power generation systems include hydrazine monopropellant actuators, storable hypergolic thrusters using monomethyl hydrazine/nitrogen tetroxide, and propulsion devices using halogen containing solid propellants. These systems all pose significant environmental problems and have high associated costs. Alternatively, traditional hypergolic bipropellants have been used, but have proved to be carcinogenic and toxic, as well as difficult and dangerous to manufacture.

In the past, hydrogen peroxide, as well as polar organic species such as alcohols have been used as components of bipropellants, mainly for rockets. However, inorganic contaminants in the hydrogen peroxide yielded an inadequate maximum upper concentration limit of hydrogen peroxide, which could be safely and effectively used in the bipropellant. Addition of hydrogen peroxide above these concentration limits created an unstable bipropellant system, both in usage and in storage.

When using traditional high strength hydrogen peroxides, long term containment, safe/practical enrichment and controlled catalytic decomposition problems have occurred. Hydrogen peroxide stored in non vented metallic containers posed a formidable problem, due to unplanned catalytic decomposition. In addition, traditional distillation technology yielded 90% hydrogen peroxide. Above 90%, the hydrogen peroxide vapors are detonable at the conditions of the distillation. Fractional crystallization is also a difficult separation technique due to water occlusion in hydrogen peroxide crystals. These technical problems were overcome by massive defense spending, which allowed for the use of extremely expensive and complex materials. However, with current decreased defense spending, low cost and life cycle waste generation become increasingly important factors in the development and manufacture of defense related products. The use of expensive and complex materials to overcome the above mentioned problems have now become impractical.

Researchers began evaluating alternative fuels for divert and attitude control systems (DACS) that would be shipboard compatible. Traditional hypergolic bipropellants usually involve hydrazine derivatives as the fuel and either inhibited red fuming nitric acid (IRFNA) or nitrogen tetroxide (NTO) as the oxidizer. As a result of these studies, a combination of concentrated hydrogen peroxide and JP-10, a jet fuel, derivative fuels as a potential DACS candidate. This concept and technology evolved over the years, and culminated with the development of a new class of hypergolic fuels.

A non-toxic hypergolic miscible bipropellant (NHMB) was developed to provide quickly renewable, hypergols which are non-toxic and form either solutions or true colloids. Please refer to U.S. Pat. No. 5,932,837 issued Aug. 3, 1999 to Rusek, et al. NHMB also provides a non-toxic hypergolic miscible fuel, which can be used in combination with a rocket grade hydrogen peroxide to form a safe, non-toxic miscible bipropellent with rapid ignition capabilities. In addition, NHMB provides a non-toxic hypergolic miscible fuel containing an inorganic metal salt, which reacts to form a catalyst in solution. This new bipropellant is especially applicable for use in divert/attitude control systems, orbit transfer systems, thrusters, large launch vehicle applications, as well as any motive power engines.

The concept of NHMF was derived from earlier research involving catalyst-doped JP fuels, specifically JP-10. These fuels were treated with a complex manganese organometallic compound and were not hypergolic with any concentration of rocket grade hydrogen peroxide (RGHP). The non-polarity of JP-10 and the polarity of RGHP did not lend itself to proper mixing of the two fuels, stifling chances of hypergolicity. In addition, theoretical energy calculations of the combination of the fuels and RGHP resulted in an optimum oxidizer to fuel ratio in the range 8–10. The next step was to find catalytically active manganese or other transition metal compound, which was soluble in a lower molecular weight, polar, flammable solvent.

Unfortunately, the NHMF of U.S. Pat. No. 5,932,837 was found to form a precipitate over time. The formation of the precipitate is accelerated by heat and by the presence of water. This raises a concern regarding the long term storability and subsequent performance of the NHMF in a propulsion system.

SUMMARY OF THE INVENTION

The present invention provides a non toxic bipropellent containing NHMF and rocket grade hydrogen peroxide oxidizer that resists the formation of precipitate over time when exposed to extreme heat. This is accomplished by buffering the pH of the NHMF in the origin of acidity with acetic acid and alkali acetate and the addition of a polar amide species to increase the polarity of the polar species of a lower alcohol. Increasing the polarity of the polar species keeps the solids soluble.

One object of the present invention to provide a NHMF which can be used in combination with a rocket grade hydrogen peroxide to form a safe, non toxic miscible bipropellent with rapid ignition capabilities and provide a NMHF, which remains stable when subjected to variations in temperature.

Another object of the invention is to provide a NHMF with improved storability.

A still further object of the invention is to provide a NHMF formulation, which minimizes or eliminates the formation of precipitate, especially when exposed to extreme heat.

The present invention provides a non toxic bipropellent containing a non toxic hypergolic miscible fuel (NHMF) and rocket grade hydrogen peroxide oxidizer. The non toxic hypergolic miscible fuel contains about 60 to 90 weight % polar organic species miscible with hydrogen peroxide, about 1.0- to 15 weight % propagator, about 5.0 to 23 weight % inorganic metal salts which react to form a catalyst in solution or as a colloid, about 1.0 to 10 weight % acetic acid, and about 1.0 to 10 weight % alkali acetate. The polar organic species can be C1 to C6 alcohols and/or C1 to C4 ketones, the propagator can be substituted or unsubstituted amides, amines and diamines, the inorganic metal salts is selected from the group consisting of manganese, copper, cobalt and iron, the acetic acid can be glacial acetic acid, and the alkali acetate can be potassium acetate, sodium acetate, and lithium acetate. Preferably, the hydrogen peroxide of the present invention consists of about 85 to 100 weight % hydrogen peroxide

BRIEF DESCRIPTION OF THE SEVERAL VIEWS OF THE DRAWING

Not Applicable.

DETAILED DESCRIPTION OF THE INVENTION

Recently, with new analysis methods, it is possible to precisely determine types and quantities of contaminants present in the hydrogen peroxide. Knowing the types and quantities of contaminants present in the hydrogen peroxide, it is now possible to produce safer, higher concentration hydrogen peroxide for use in a bipropellent.

The NHMF of the present invention contains 5 species. Namely, a polar organic species or a mixture of polar organic species miscible with hydrogen peroxide; a propagator which is a basic organic species such as substituted or unsubstituted amines, amides or diamines; inorganic metal salts, which act as a catalyst and are miscible with the polar organic species and the propagator in solution; acetic acid; and alkali acetate such as potassium acetate, lithium acetate, and sodium acetate.

Initially, various manganese compounds were tested for catalytic activity. Manganese was originally the transition metal of choice because of its relatively low toxicity and carcinogenicity. It has also been shown, in various chemical states, to be an excellent decomposition catalyst for RGHP. Manganese acetate tetrahydrate (MAT) proved to be the most promising compound that was tested, resulting in sparks and evolved gas when put in contact with RGHP. Other divalent manganese compounds, such as manganese nitrate and manganese sulfate, did not show such promise. The acetate anion associated with the manganese provided a fuel to burn instantaneously when contacted by the heat generated by decomposing RGHP.

The logical choices for solvents were the lower molecular weight alcohols. They are miscible with RGHP and require much less oxidizer to combust completely and efficiently. This results in a lower optimum oxidizer to fuel ratio, in the range of 2.5 to 3.5, depending on the alcohol used. MAT is conveniently soluble in the lower alcohols, more so in the lower molecular weight species, methanol and ethanol. Propanol and propargyl alcohol may also be used. Methanol was chosen for its increased solubility with MAT. By having a solvent such as methanol with a low flash point, the heat generated by decomposing RGHP with MAT is enough to cause an ignition.

Mixing MAT with methanol results in a light pink-brown transparent solution, but over a few hours begins to form a brown colloidal suspension of manganese oxide, $Mn_3O_4$. A small amount of MAT (approximately 1–2%) is dissociated in to $Mn^{2+}$ ions and free acetate ions, as determined by Fourier Transform Infrared Spectroscopy. The $Mn^{2+}$ ions are readily converted to $Mn_3O_4$ due to the basic nature of the solution. The acetate is concurrently converted to methyl acetate, increasing solution basicity even further. By itself, the $Mn_3O_4$ formed shows little or no reactivity with RGHP, so therefore it is likely that it does not facilitate the hypergolic reaction between RGHP and NHMF.

Over about 18 months, it has been shown that the $Mn_3O_4$ formed in NHMF remains suspended in the fuel, if the fuel is kept at room temperature (25° C.±3°). However, if the fuel is heated to warm conditions (>40° C.), the manganese oxide will precipitate out of suspension. Controlled tests confirmed this fact, resulting in precipitation after storing the fuel in 50° C. conditions for 5 days.

After discovering the problem of temperature dependent precipitation, work continued to improve the stability of NHMF. The formation of manganese oxide is apparently due to potassium acetate. Acetic acid is a relatively innocuous acid that can be added easily without adding any water to the fuel. Acetic acid is added for solubility and stability enhancement. The potassium acetate yields free acetate ions, which complete the buffer with acetic acid. Acetamide is added to keep all the solids soluble by increasing the polarity of the methanol. These new formulations involving acetic acid/acetate buffer have shown excellent stability during room temperature storage, and high and low temperature storage. The NHMF's retain their low toxicity, and gain some storability, as well as consistency in composition over time.

In a preferred embodiment of the invention, about 60 to 90 weight % polar organic species, and about 5.0 to 23 weight % inorganic metal salt catalyst are mixed to form the NHMF. About 1.0 to 15 weight % polar amide species, about 1.0 to 10 weight % acetic acid, and about 1 to 10 weight % alkali acetate are added to the NHMF. The polar organic species consists of a lower alcohol such as methanol, butanol, ethanol or propanol, propargyl alcohol, or any mixture thereof. The catalyst consists of manganese acetate tetrahydrate. The inorganic metal salt catalyst reacts when placed into solution with the polar organic species to form a microdispersed colloidal manganese oxide and acetic acid. The acetic acid, produced by the reaction of the inorganic metal salt catalyst in solution, acts as a propagator. The inorganic metal salt catalyst is selected from the group consisting of hydrated or unhydrated manganese acetate, copper acetate, iron acetate, cobalt acetate, manganese nitrates, copper nitrates, iron nitrates and cobalt nitrates. The alkali acetate is selected from the group consisting of potassium acetate, sodium acetate, and lithium acetate. The polar amide species is selected from the group consisting of acetamide, formamide, N,N dimethyl acetamide, and dimethyl formamide.

In a more preferred embodiment, methanol is used as the polar organic species; manganese acetate tetrahydrate is used as the manganese acetate hydrate; acetamide is used as the polar amide species; potassium acetate is used as the alkali acetate; and glacial acetic acid is used as the acetic acid.

Although the description above contains many specificities, these should not be construed as limiting the scope of the invention but as merely providing an illustration of the presently preferred embodiment of the invention. Thus the scope of this invention should be determined by the appended claims and their legal equivalents.

EXAMPLES

Exact weight percentages of ingredients are shown are shown in table 1. All formulations involving only two ingredients are weighed separately and mixed by shaking in a sealed container. All other formulations are made by mixing and dissolving all components, except manganese acetate tetrahydrate (MAT), then adding MAT to the resulting solution. This procedure ensures that the methanol is properly buffered with acetic acid/acetate before dissolving MAT.

TABLE 1

NHMF formulations and corresponding manganese content.

| Formulation | Composition (weight %) | % Mn |
|---|---|---|
| 49A (Block O) | 77.7% MeOH, 22.3% MAT | 5 |
| 49B | 82.2% MeOH, 17.9% MAT | 4 |
| 49C | 86.6% MeOH, 13.4% MAT | 3 |
| 49D | 91.1% MeOH, 8.9% MAT | 2 |
| 90A | 73.6% MeOH, 13.4% MAT, 7.0% Acet., 5.0% GAA, 1.0% KOAc | 3 |
| 90B | 69.2% MeOH, 17.8% MAT, 7.0% Acet., 5.0% GAA, 1.0% KOAc | 4 |
| 90C | 64.7% MeOH, 22.3% MAT, 7.0% Acet., 5.0% GAA, 1.0% KOAc | 5 |
| 91A | 78.1% MeOH, 8.9% MAT, 7.0% Acet., 5.0% GAA, 1.0% KOAc | 2 |

MAT = manganese acetate Tetrahydrate,
MeOH = methanol,
Acet = Acetamide,
GAA = glacial acetic acid,
KOAc = potassium acetate,
Mn = Manganese Cold and hot storage tests were performed on all NHMF formulations. The cold storage test involved a gradual decrease from room temperature to −29° C. at a rate no greater than 3° C./ min. Then, the samples were subjected to a temperature of −29° C. for 5 days. The hot storage test involved a gradual increase from room temperature to 54° C. at a rate no greater than 3° C./ min. Then, the samples were subjected to a temperature of 54° C. for 5 days. Samples were removed in the reverse manner and visually inspected for precipitation. In addition hypergolicity tests were performed before and after the temperature tests. The results of these tests are shown in Table 2.

TABLE 2

Results of hot and cold temperature storage tests. Hypergolicities were measured with 98% H2O2.

| Formulation | Precipitation after/during cold storage | Precipitation after/during hot storage | Hypergolicity before cold storage | Hypergolicity before hot storage | Hypergolicity after cold storage | Hypergolicity after hot storage* |
|---|---|---|---|---|---|---|
| 49A (Block O) | no | yes | Yes | yes | yes | yes |
| 49B | no | yes | Yes | yes | yes | yes |
| 49C | no | yes | Yes | yes | yes | yes |
| 49D | no | yes | Yes | yes | yes | yes |
| 90A | no | no | Yes | yes | yes | yes |
| 90B | no | no | Yes | yes | yes | yes |
| 90C | no | no | Yes | yes | yes | yes |
| 91A | no | no | Yes | yes | yes | yes |

*Formulations with precipitation were filtered to .4 $\mu$m prior to testing.

Since various changes and modifications can be made in the invention without departing from the spirit of the invention, the invention is not to be taken as limited except by the scope of the appended claims.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A non-toxic bipropellant comprising a non-toxic hypergolic miscible fuel (NHMF) and rocket grade hydrogen peroxide oxidizer, wherein said non-toxic miscible fuel comprises:

about 60 to 90 weight % polar organic species comprising a lower alcohol;

about 5 to 23 weight % catalyst comprising manganese acetate hydrate;

about 1 to 15 weight % polar amide species;

about 1 to 10 weight % acetic acid; and about 1 to 10 weight % alkali acetate.

2. The non-toxic bipropellant of claim 1, wherein said polar organic species is selected from the group consisting of methanol, butanol, ethanol, propanol, propargyl alcohol, and any mixture thereof.

3. The non-toxic bipropellant of claim 1, wherein said alkali acetate is selected from the group consisting of potassium acetate, sodium acetate, and lithium acetate.

4. The non-toxic bipropellant of claim 1, wherein said polar amide species is selected from the group consisting of acetamide, formamide, N,N dimethyl acetamide, and dimethyl formamide.

5. The non-toxic bipropellant of claim 1, wherein said manganese acetate hydrate is selected from the group consisting of manganese acetate tetrahydrate, and manganese acetate monohydrate.

6. The non-toxic bipropellant of claim 1, wherein said acetic acid is glacial acetic acid.

7. The non-toxic bipropellant of claim 1, wherein said non-toxic bipropellant has an oxidizer-to-fuel ratio in the range of about 2.5 to 3.5.

8. The non-toxic bipropellent of claim 2, wherein said rocket grade hydrogen peroxide comprises about 85 to 100 weight % hydrogen peroxide.

9. A non toxic bipropellent comprising a non-toxic hypergolic miscible fuel (NHMF) and rocket grade hydrogen peroxide oxidizer, wherein said non-toxic hypergolic miscible fuel comprises:

about 60 to 90 weight % polar organic species miscible with hydrogen peroxide, selected from the group consisting of C1 to C6 alcohols and C1 to C4 ketones;

about 1.0 to 15 weight % propagator selected from the group of basic organic species consisting of substituted or unsubstituted amines, amides and diamines;

about 5.0 to 23 weight % inorganic metal salts which reacts to form a catalyst in solution or a colloid, said inorganic metal salts miscible with said polar organic species and said propagator in solution, said soluble inorganic salt is selected from the group consisting of manganese, copper, cobalt and iron as the metal ion, wherein said catalyst has a faster rate of reaction with said rocket grade hydrogen peroxide than said propagator, said propagator has a faster rate of reaction with said rocket grade hydrogen peroxide than said polar organic species, and said polar organic species, propagator and catalyst are mutually soluble;

about 1 to 10 weight % acetic acid; and about 1 to 10 weight % alkali acetate.

10. The non-toxic bipropellant of claim 9, wherein said polar organic species is selected from the group consisting of methanol, ethanol, butanol, propanol, propargyl alcohol, and any mixture thereof.

11. The non-toxic bipropellent of claim 9, wherein said catalyst is selected from the group consisting of either hydrated or unhydrated manganese acetate, copper acetate, iron acetate, cobalt acetate, manganese nitrates, copper nitrates, iron nitrates and cobalt nitrates.

12. The non-toxic bipropellent of claim 9, wherein said propagator is selected from the group consisting of urea (carbamide), formamide, acetamide, ethylene diamine tetraacetic acid (EDTA) and basic substituted EDTA.

13. The non-toxic bipropellant of claim 9, wherein said non-toxic bipropellant has an oxidizer-to-fuel ratio in the range of about 2.5 to 3.5.

14. The non-toxic bipropellent of claim 9, wherein said rocket grade hydrogen peroxide comprises about 85 to 100 weight % hydrogen peroxide.

15. The non-toxic bipropellant of claim 9, wherein said alkali acetate is selected from the group consisting of potassium acetate, sodium acetate, and lithium acetate.

16. The non-toxic bipropellant of claim 9, wherein said acetic acid is glacial acetic acid.

* * * * *